US008826932B2

(12) United States Patent
Seal et al.

(10) Patent No.: US 8,826,932 B2
(45) Date of Patent: Sep. 9, 2014

(54) DIVERTER VALVE

(75) Inventors: Michael Seal, Essex (GB); Derek Sumsion, Essex (GB); Anthony Harman, Essex (GB)

(73) Assignee: TCL Manufacturing Limited (GB)

( * ) Notice: Subject to any disclaimer, the term of this patent is extended or adjusted under 35 U.S.C. 154(b) by 1363 days.

(21) Appl. No.: 12/596,222

(22) PCT Filed: Apr. 16, 2008 (Under 37 CFR 1.47)

(86) PCT No.: PCT/GB2008/001339

§ 371 (c)(1), (2), (4) Date: Jun. 25, 2010

(87) PCT Pub. No.: WO2008/125865

PCT Pub. Date: Oct. 23, 2008

(65) Prior Publication Data

US 2011/0030823 A1 Feb. 10, 2011

(30) Foreign Application Priority Data

Apr. 16, 2007 (GB) ..... 0707326.5

(51) Int. Cl.

| | |
|---|---|
| ***E03C 1/048*** | (2006.01) |
| ***F16K 11/07*** | (2006.01) |
| ***E03C 1/04*** | (2006.01) |

(52) U.S. Cl.

CPC ..... *E03C 1/04* (2013.01); *E03C 2201/30* (2013.01); *E03C 2201/40* (2013.01)

USPC ..... 137/119.04; 137/594; 137/597; 137/874; 137/625.48; 4/678

(58) Field of Classification Search

USPC ..... 137/594, 597, 606, 119.04, 119.05, 137/873, 874, 625.48, 625.49; 4/678

See application file for complete search history.

(56) References Cited

U.S. PATENT DOCUMENTS

| | | | | |
|---|---|---|---|---|
| 2,949,933 | A | 8/1960 | Moen | |
| 5,205,313 | A * | 4/1993 | Moretti | 137/112 |
| 5,931,191 | A * | 8/1999 | Taube et al. | 137/594 |
| 6,978,795 | B2 | 12/2005 | Perrin | |
| 7,090,144 | B2 * | 8/2006 | Gross et al. | 239/26 |
| 7,096,879 | B2 | 8/2006 | Yardley | |
| 2002/0162586 | A1 | 11/2002 | Perrin | |
| 2007/0235091 | A1 * | 10/2007 | Granot | 137/597 |

FOREIGN PATENT DOCUMENTS

DE 3413616 10/1985

OTHER PUBLICATIONS

International Preliminary Report on Patentability dated Oct. 20, 2009 in Application No. PCT/GB2008/001339.

Written Opinion dated Oct. 16, 2009 in Application No. PCT/GB2008/001339.

International Search Report from corresponding PCT Application No. PCT/GB08/001339 dated Jul. 30, 2008.

* cited by examiner

*Primary Examiner* — Steve Hepperle
*Assistant Examiner* — Atif Chaudry
(74) *Attorney, Agent, or Firm* — Snell & Wilmer L.L.P.

(57) ABSTRACT

A diverter valve which is operable to divert a water supply to a spray includes an undiverted through passage for another water supply, such as filtered water.

15 Claims, 5 Drawing Sheets

DIVERTER VALVE

CROSS-REFERENCE TO RELATED APPLICATIONS

This application is U.S. national phase filing under 35 U.S.C. §371 of PCT/GB2008/001339 filed Apr. 16, 2008 and claims priority from United Kingdom Application No. GB 0707326.5 which was filed on Apr. 16, 2007.

This invention relates to a diverter valve, particularly for use in domestic and light commercial taps or faucets, and to a tap assembly incorporating a diverter valve.

Diverter valves are commonly used in water tap or faucet assemblies to divert water between a spout and a hand spray. U.S. Pat. No. 7,096,879, the contents of which are incorporated herein by reference, describes a sink mixer tap arrangement with a hand spray and a diverter valve at the base of the tap spout. When the spray is operated, i.e. the spray outlet valve is opened, the diverter valve closes to shut off the flow of water to the spout. When the spray is shut off, the diverter valve automatically opens to allow water to flow through the spout again.

The valve may comprise both hot and cold water inlets and facilitate mixing of the hot and cold water. For example, U.S. Pat. No. 2,949,933 describes a hot and cold water mixing valve which can automatically divert the mixed hot and cold water from a principle outlet passage to an auxiliary outlet passage when a control valve on the auxiliary passage is opened.

U.S. Pat. No. 6,978,795, the contents of which are incorporated herein by reference, describes a mixer tap with a diverter valve in the tap body. The tap of U.S. Pat. No. 6,978,795 delivers hot, cold and filtered water under the control of respective valves mounted on the tap body. In that case, the hand spray is intended only for delivering hot and cold water, and so the filtered water path in the tap body bypasses the diverter valve and does not connect with the feed to the hand spray. This bypass arrangement requires a complex flow path in the tap body to bypass the diverter valve.

In one aspect the present invention provides a diverter valve having an undiverted water flow path through the valve which is not interrupted by operation of the diverter valve.

In one form, the undiverted water flow path passes axially through the valve.

The valve may be assembled around a central tubular member which forms the undiverted water flow path. A shuttle member reciprocates along the outside of the tubular member. The shuttle member has a valve head at one end which cooperates with a surrounding valve seat to shut off flow of water to the tap spout when the diverter is actuated.

More particularly, the invention provides a diverter valve for a water supply, the diverter valve having an undiverted flow path through the diverter valve which is not interrupted by operation of the diverter valve.

The undiverted flow path may pass in an axial direction through the diverter valve, and may lie on a centre axis of the diverter valve. A tube having an inlet end and an outlet end may form the undiverted flow path. A shuttle assembly incorporating a valve member may be slidably mounted on the tube.

The valve member may have a valve head at one end which cooperates with a surrounding valve seat when the valve member is urged in a first direction, to shut off flow of water in the opposite direction.

A flow regulator may be provided to control the rate of flow of water to the spray.

An upper end cap may be provided at one end of the tubular member for fluidly connecting the tubular member with an outlet spout. A bottom end cap may be provided at another end of the tubular member for fluidly connecting the tubular member with a water supply.

The invention also provides a water tap comprising a body, valve means controlling at least two water supplies to the body, spout means connected to the body and forming an outlet for the water supplies, spray means connected to the body, and a diverter valve which is operable to divert at least one of the water supplies to the spray means when the spray means is actuated and substantially prevent flow of at least one other of the water supplies to the spout, wherein the diverter valve includes a through passage for the at least one other of the water supplies which remains open during operation of the diverter valve. The diverter valve may include a tubular member defining the through passage.

In another aspect the invention provides a water tap comprising a body, valve means controlling at least two water supplies to the body, a spout connected to the body and forming an outlet for the water supplies, a spray connected to the body, and a diverter valve which is operable to divert one of the water supplies to the spray when a valve for the spray is actuated and to substantially prevent flow of a second one of the water supplies to the spout, wherein the diverter valve includes a through passage for the second one of the water supplies which remains open during operation of the valve.

The water supplies may comprise hot, cold and filtered water. The diverter through passage may be for the filtered water supply.

Other aspects and optional features of the invention will be apparent from the following description and the accompanying claims.

The invention will be described by way of example only with reference to the accompanying drawings, in which:

FIG. 1 is a perspective view of a water tap incorporating a diverter valve in accordance with the invention;

FIGS. 2*a* and 2*b* are schematic cross-sectional views through a tap body housing a diverter valve in accordance with the invention;

Figure 1:
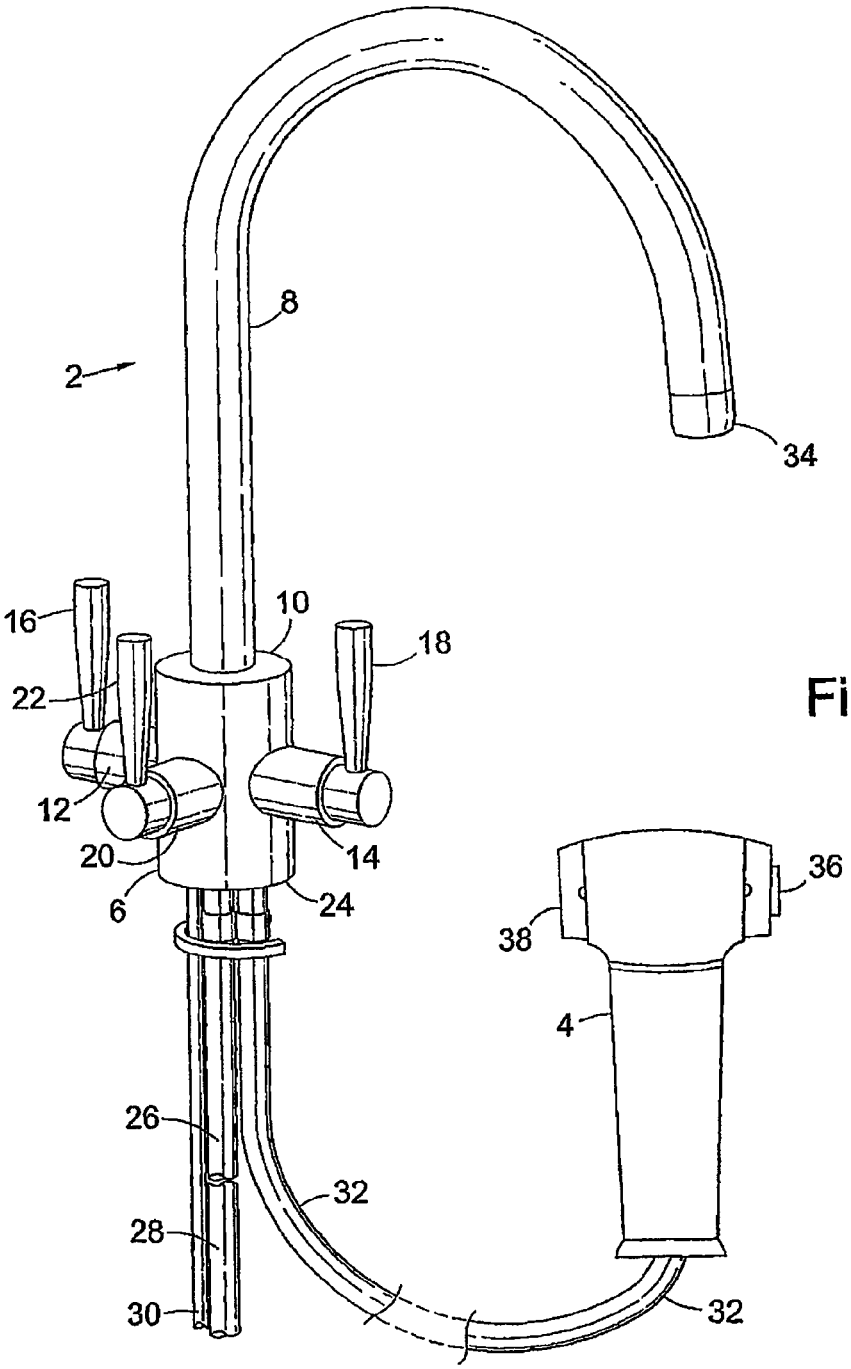

FIG. 1 shows a water tap 2 incorporating a diverter valve in accordance with the invention. Tap 2 is of the general type described in U.S. Pat. No. 6,978,795 for delivering hot, cold and filtered water and is connected with spray means In the form of a spray 4 which may be used for rinsing, etc. as known in the art. Tap 2 has a body 6 formed of brass with spout means in the form of a water outlet spout 8, also of brass, mounted in the top end 10 of the body and swivellable about the body axis. Valve means in the form of hot and cold water valves 12, 14 are mounted diametrically opposite one another on the body 10 and actuated by levers 16, 18. A filtered water valve 20 is mounted on the body in the same plane as the hot and cold valves 12, 14 and actuated by a lever 22. Extending down from the bottom end 24 of the tap body 6 are hot and cold water inlets 26, 28 (positioned one behind the other in the drawing), a filtered water inlet 30, and an outlet 32 to the spray 4.

In operation, hot and cold water are fed to the tap body 6 via inlets 28, 30 and valves 12, 14 are actuated by moving levers 16, 18 to flow hot and cold water through the spout 8 to the spout outlet 34. The hot and cold water may be mixed in the body 6 and/or during passage through spout 8. Filtered water is supplied to inlet 30 via a water filter (not shown) and flows out through a tube provided in spout 8 (see FIGS. 2*a* and 2*b* hereinafter), to outlet 34, thus keeping the filtered water separate from the hot and cold water to avoid contamination. The filtered water flow is controlled by valve 20 and lever 22. When the hot and/or cold water are flowing though the spout 8, i.e. valves 12, 14 are open, a user can press the push button 36 on spray 4 to open a valve (not shown) in spray 4 to cause water to flow through outlet 32 to spray outlet nozzle 38. As the spray valve is opened, a diverter housed in the body 6 is actuated to shut off the water flow to nozzle 8. The arrangement thus far described is well known in the art. Although tap 2 is a tap delivering hot, cold and filtered water, it will be appreciated by those in the art that the invention herein is also useful with other taps, such as those delivering only hot and cold water, i.e. not filtered water, and taps delivering cold and filtered water, for example. Most typically, the spray 4 is used with cold and/or hot water for rinsing.

Figure 2B:
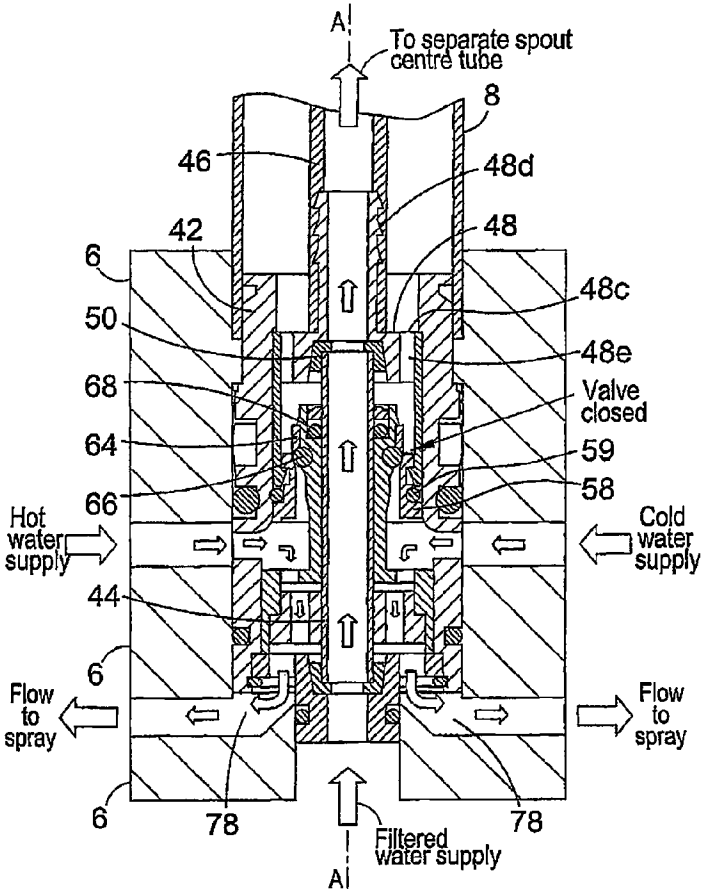
Figure 2A:
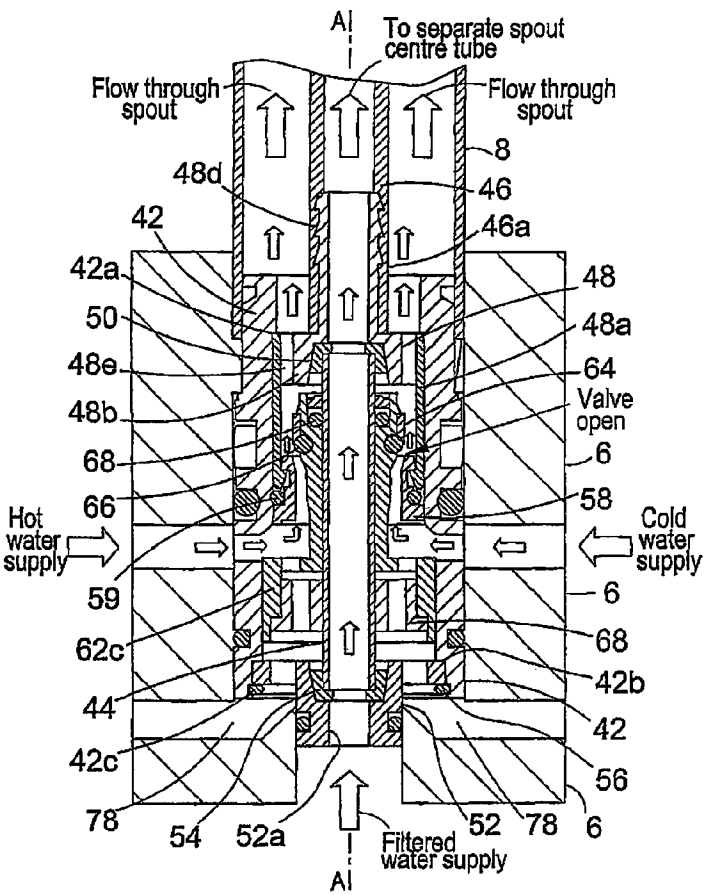
Figure 3:
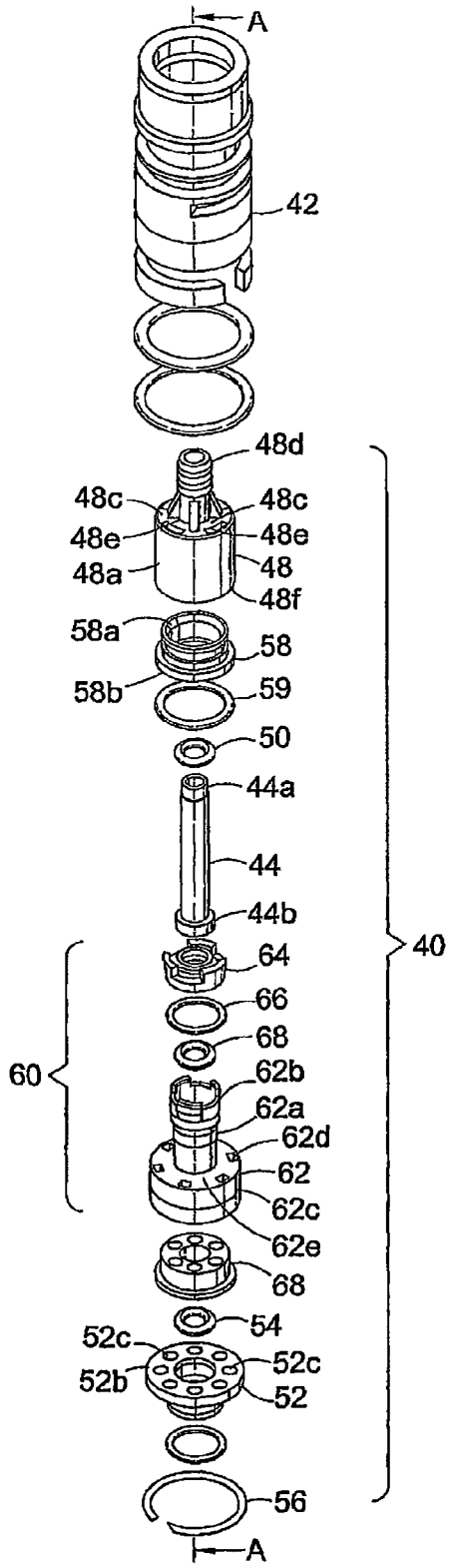
FIG. 3 is an exploded view of a diverter valve assembly.

FIGS. 2*a* and 2*b* show a vertical cross-section through a diverter valve 40 of the invention, housed in tap body 6, which is illustrated schematically in these Figures. The diverter valve 40 is housed in a spout nipple 42 which mounted fast in the lower end 44 of the spout 8 by soldering. Nipple 42 is rotatable about its axis in body 6 as the spout 8 is swivelled from side to side. A grub screw, not shown, extends through the wall of body 6 into a circumferential recess in the outer surface of nipple 42 to hold the nipple 42 in the body 6, as known in the art.

Diverter valve 40 comprises a central tube 44 of brass which extends in the axial direction along the centre axis A-A of the diverter valve and forms an undiverted water flow path or through passage for filtered water to pass though the diverter valve from filtered water inlet 30 to a plastics tube 46 which runs through spout 8 to the outlet 34. This undiverted water flow path remains open during operation of the diverter valve.

Intermediate the upper, outlet end 44*a* of the tube 44 and the plastics tube 46 is an upper end cap 48 in the form of a plastics moulding. Upper end cap 48 has an outer cylindrical portion 48*a* which is snugly received in the nipple 42 and bears on a ledge 42*a* in the nipple 42 to limit upward movement of the upper end cap 48. Upper end cap 48 has an inner cylindrical portion 48*b* joined to the outer portion by webs 48*c* and is mounted on the upper end 44*a* of tube 44 via an elastomeric upper seal 50. A barbed outlet tube 48*d* extends up from the end wall 48*e* of the upper end cap 48 and is a force fit into the end 46*a* of plastics tube 46 to fluidly connect the tube 44 with the tube 46 of the spout 8. The space 48*e* between the inner and outer cylindrical portions 48*a*, 48*b* forms a flow path for hot and cold water to enter the spout 8 (outside the tube 46) from the tap body 6, the water flowing between webs 48*c*.

The lower, inlet end 44*b* of tube 44 is received in a moulded plastics bottom end cap 52. End cap 52 seals against tube end 44*b* via an elastomeric lower seal 54. Bottom end cap 52 has a central bore 52*a* forming an inlet for filtered water from inlet 30 to fluidly connect the tube 44 with a space in the tap body 6 which receives water from the filtered water inlet 30 via valve 20 under the control of lever 22. Bottom end cap 52 has a disc shaped plate 52*b* which is a snug fit in the nipple 42 and seats against a ledge 42*b*. Apertures 52*c* in the plate 52*b* provide a through passage for hot and cold water to flow to the spray 4 via outlet 32. A circlip 56 sits in a groove in the inner surface of the nipple wall to hold the assembly comprising tube 44 and end caps 48, 52 in place in the nipple 42.

A diverter valve seat 58 of brass is a snap fit in the lower end 48*f* of the upper end cap 48. Valve seat 58 has a conical inner sealing surface 58*a* at its upper end. An O-ring 59 sits in a groove in the outer surface of the valve seat 58 and forms a seal with the inner surface of the nipple 42.

A shuttle assembly 60 forms a valve member which is slidably mounted on the outer surface of the tube 44. Assembly 60 comprises a plastics shuttle body 62 having a stem 62*a* with a bore which is a sliding fit on the brass tube 44. At the upper end 62*b* of stem 62*a*, a seal cap 64 is a snap fit on the end 62*b* of the stem 62*a* and holds a soft O-ring 66 in place on the outer surface of the stem 62*a*. O-ring 66 forms a valve head and seals with the conical inner surface 58*a* of the valve seat 58 (see FIG. 2*b*), when the spray 4 is operational. Seal cap 64 also holds an O-ring 68 in place against the outer surface of the tube 44. O-ring 68 forms a dynamic seal between the shuttle body 62 and the tube 44, to allow sliding movement of the shuttle body along the tube but to prevent leakage of water through to the spout 8 when the diverter valve is closed. The lower end of shuttle 62 forms a cup 62*c* which may house a flow regulator 68. The circumferential wall of cup 62*c* is tapered inwardly towards the bottom, open end of the cup to provide a snap fit location for a flow regulator 54. Apertures 62*d* in the upper wall 62*e* of cup 62*c* allow water to flow through to spray 4. The volume of water flow is limited by regulator 54, in this case to about 5 liters per minute. Flow regulator 68 is represented somewhat schematically. Such regulators are known in the art, and we prefer a regulator supplied by 'Neoperl'. We refer also to U.S. Pat. No. 6,978,795.

In operation, filtered water is fed though the tube 44 and so is unaffected by operation of the diverter valve 40, i.e. movement of the shuttle 60. With the spray 4 'off', hot and/or cold water are fed into the nipple 42 under the control of valves 12, 14 and pass between the valve seat 58 and the O-ring 66 and up into the spout 8, as shown in FIG. 2*a*. When the valve in spray 4 is opened by pressing button 36, the shuttle assembly 60 is caused to move in a first direction, downwards as shown in FIG. 2*b*, because there is force of water applied to the larger surface area presented by the upper wall 62*e* of cup 62*c*, as compared to that applied to the upper end of the shuttle assembly 60, as well known in the art. The valve head formed by O-ring 66 thus seals against the sealing surface 58*a* of valve seat 58 so the water does not continue to flow in the opposite direction, though to spout 8. When the button 36 is released, spray 4 shuts off, and so the pressure differential reverses and shuttle assembly 60 moves upwards on tube 44 to open the diverter valve and allow hot and cold water to flow between valve seat 58 and the valve head (O-ring 66) and through to spout 8.

When provided, the flow regulator 68 helps to maintain a continuous over-pressure on the cup wall 62*e* to urge the shuttle body 62 downwards and form a continuous seal between O-ring 66 and valve seat sealing surface 58*a* to prevent leakage and unwanted reciprocation of the shuttle 60 if water pressure fluctuates.

Figure 4:
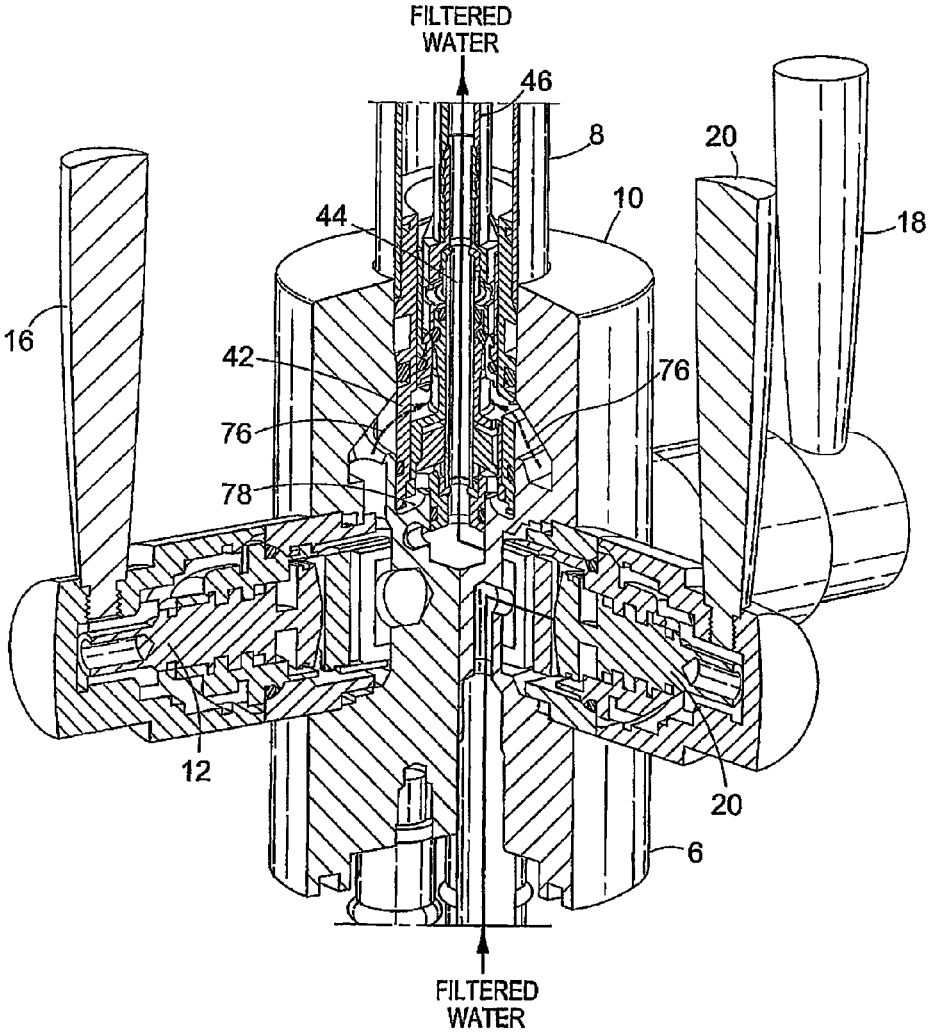
FIG. 4 is a partial view, cut away, of the tap of FIG. 1, showing the diverter valve in place.

A coil spring may be provided between cup wall 62*e* and the bottom end 58*b* of the valve seat 58. This will apply a slight biasing force urging the shuttle member 60 downwards to close the diverter valve 40. The force of the spring helps overcome any tendency of the shuttle member to stick in the open position. Referring further to FIG. 4, this shows the path of filtered water through the tap 2. Water enters at inlet 30 and passes via a ceramic disc valve 20 into a space 72 in the tap body, below the diverter valve 40. The filtered water then passes up tube 44 to the tube 46 through spout 8. Hot and cold water enter the tap body via valves 12, 14 into a cavity 76 to enter the diverter valve 40 though spout nipple 42 and then up to spout 8, or downwards to a lower cavity 78 depending on whether the diverter valve is open of closed, respectively.

The stem 62*a* of the shuttle body 62, below the O-ring 66, tapers outwardly in the direction of the O-ring so as to gradually close of the flow path between the stem 62*a* and the valve seat 58 as the shuttle member 60 moves downwards to close the diverter valve 40.

The undiverted flow path may be used for other functions, for example to deliver soap past the diverter valve.

Although it is desirable to keep the filtered water separate from the hot and cold water, tube 46 can be omitted from spout 8. Also, although the invention has been described with respect to a tap for delivering hot, cold and filtered water, it is applicable to other taps. For example it could be used with a tap supplying hot and cold water only, with one, the hot water say, flowing thorough the tube 44 to avoid the diverter, and the other being diverted to the spray 4 when the spray is operated.

Figure 5B:
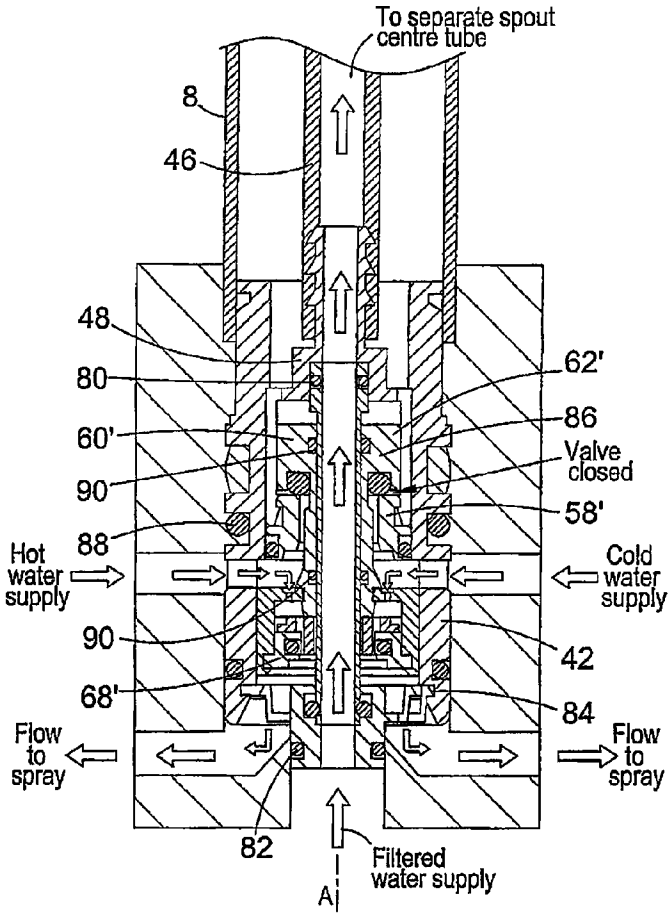
FIGS. 5*a* and 5*b* are views similar to FIGS. 2*a* and 2*b* and showing a second embodiment of a diverter valve in accordance with the invention.
Figure 5A:
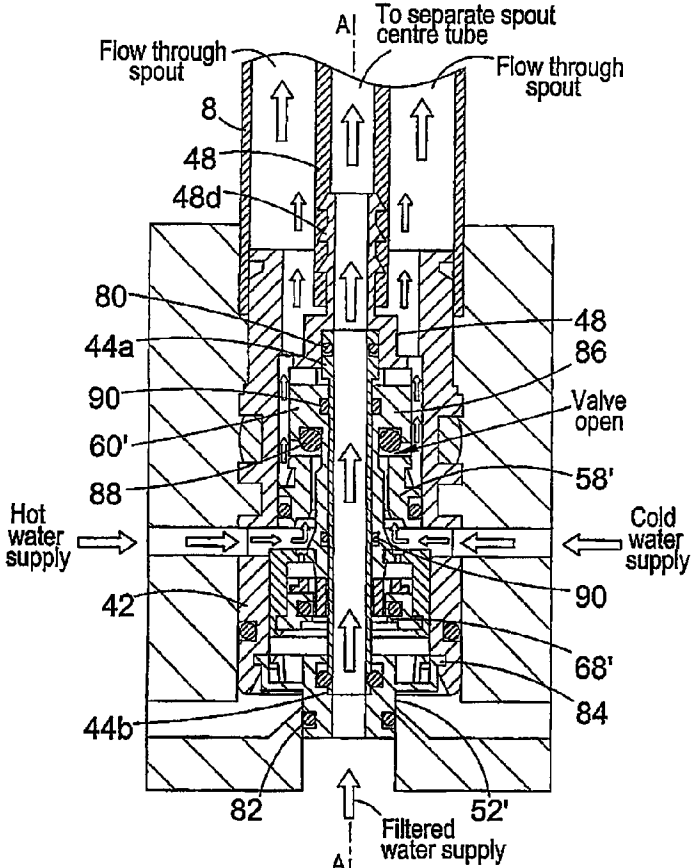

Referring to FIGS. 5*a* and 5*b*, these show vertical cross-sectional views through a second embodiment of a diverter valve of the invention installed in a tap body. The construction and operation is similar to that shown and described with reference to FIGS. 2*a* and 2*b*, with like parts being given like reference numerals. The following description will highlight the modifications of this embodiment relative to the first embodiment.

In place of upper seal 50, the central brass tube 44 has an enlarged upper end 44*a* which is snugly received in the upper end cap 48 and an O-ring 80 forms a seal between the tube end 44*a* and end cap 48. Similarly, in place of lower seal 54 the lower end 48*b* of tube 44 is sealed to the end cap 52 by an O-ring 82. End cap 52 is a snap fit in a circumferential groove 84 in the spout nipple 42, obviating the need for circlip 56.

The arrangement of O-ring seals 80, 82 in place of cup-like end seals 50, 54 provides a more rigid fixing of the central tube 44 which guides the shuttle assembly 60'.

Plastics shuttle body 62' has an enlarged upper end 86 which carries a downwardly facing O-ring 88 in a circular groove. As the shuttle body 62' moves downward (FIG. 5*b*), O-ring 88 bears on the upper end of the valve seat 58' to form a seal closing off the outer water flow path to the spout 8.

Shuttle body 62' is sealed to the tube 44 by two O-rings 90 seated in respective circumferential grooves in the inner wall of shuttle body 62'.

Flow regulator 68' carried on the lower end of shuttle body 62' is similar to the flow regulator shown in U.S. Pat. No. 6,978,795.

The invention claimed is:

1. A diverter valve for a water supply, the diverter valve having an undiverted flow path through the diverter valve which is not interrupted by operation of the diverter valve, and comprising a tube having a tube inlet at a tube inlet end and a tube outlet at a tube outlet end and forming the undiverted flow path, wherein a valve member is slidably mounted on the tube, wherein the valve member reciprocates along the outside of the tube, wherein the diverter valve selectively diverts the water supply from an inlet, and between a first outlet and a second outlet.

2. The diverter valve as claimed in claim 1, wherein the undiverted flow path passes in an axial direction through the diverter valve.

3. The diverter valve as claimed in claim 2, wherein the flow path lies on a centre axis of the diverter valve.

4. The diverter valve as claimed in claim 1 wherein the valve member has a valve head at one end which cooperates with a surrounding valve seat when the valve member is urged in a first direction, to shut of flow of water in the opposite direction.

5. The diverter valve as claimed in claim 4, wherein a flow regulator is mounted on the valve member to control the rate of flow of water to a spray.

6. The diverter valve as claimed in claim 1, wherein an upper end cap is provided at the outlet end of the tube for fluidly connecting the tube with an outlet spout.

7. The diverter valve as claimed in claim 1, wherein a bottom end cap is provided at the inlet end of the tube for fluidly connecting the tube with a water supply.

8. The diverter valve as claimed in claim 1, wherein the inlet is perpendicular to an axis of reciprocation of the valve member.

9. The diverter valve as claimed in claim 1, wherein the first outlet and the second outlet are axially aligned.

10. A water tap comprising a body, valve means controlling at least two water supplies to the body, spout means connected to the body and forming an outlet for the water supplies, spray means connected to the body, and a diverter valve which is operable to divert one of the water supplies to the spray means when the spray means is actuated and substantially prevent flow of the at least one water supply to the spout, wherein the diverter valve includes a tubular member defining a through passage for at least one other of the water supplies, and further comprises a valve member slidably mounted on the tubular member, wherein the valve member reciprocates along the outside of the tube.

11. A water tap comprising a body, valve means controlling a water supply to the body, a spout connected to the body and forming an outlet for the water supply, a spray connected to the body, and a diverter valve which is operable to divert the water supply to the spray when a valve for the spray is actuated and to substantially prevent flow of the one water supply to the spout, wherein the diverter valve includes a tubular member defining a through passage which is not interrupted by the operation of the diverter valve, and the diverter valve comprises a valve member slidably mounted on the tubular member, wherein the valve member reciprocates along the outside of the tube.

12. The water tap as claimed in claim 11, wherein the water supply comprise hot and cold water.

13. The water tap as claimed in claim 11, wherein a filtered water supply is provided and the through passage is for the filtered water supply.

14. A diverter valve for a water supply, the diverter valve having an undiverted flow path through the diverter valve which is not interrupted by operation of the diverter valve, and comprising a tube having a tube inlet at a tube inlet end and a tube outlet at a tube outlet end and forming the undiverted flow path, wherein a valve member is slidably mounted on the tube, wherein the valve member reciprocates along the outside of the tube, wherein an inlet is perpendicular to an axis of reciprocation of the valve member.

15. The diverter valve as claimed in claim 14, wherein the diverter valve selectively diverts the water supply from the inlet, and between a first outlet and a second outlet, and wherein the first outlet and the second outlet are axially aligned.

* * * * *